US012685400B2

(12) United States Patent
Deledda

(10) Patent No.: US 12,685,400 B2
(45) Date of Patent: Jul. 21, 2026

(54) DEFORMABLE SLEEVE WITH RESILIENT CORE STRUCTURE

(71) Applicant: CRUSHMETRIC LIMITED, Mahe (SC)

(72) Inventor: Noah Deledda, Tampa, FL (US)

(73) Assignee: CRUSHMETRIC LIMITED, Mahe (SC)

( * ) Notice: Subject to any disclaimer, the term of this patent is extended or adjusted under 35 U.S.C. 154(b) by 0 days.

(21) Appl. No.: 18/350,767

(22) Filed: Jul. 12, 2023

(65) Prior Publication Data

US 2023/0346146 A1 Nov. 2, 2023

Related U.S. Application Data

(63) Continuation of application No. PCT/CN2021/074768, filed on Feb. 2, 2021.

(30) Foreign Application Priority Data

Jan. 12, 2021 (CN) ..... 202110036973.0

(51) Int. Cl.
*A47G 23/02* (2006.01)
*B65D 65/22* (2006.01)
*B65D 81/38* (2006.01)

(52) U.S. Cl.
CPC ..... *A47G 23/0266* (2013.01); *A47G 23/0216* (2013.01); *B65D 65/22* (2013.01); *B65D 81/3881* (2013.01)

(58) Field of Classification Search
CPC ..... A47G 23/0266; A47G 23/0216; B65D 65/22; B65D 81/3881
USPC ..... 220/737, 8, 666, 667
See application file for complete search history.

(56) References Cited

U.S. PATENT DOCUMENTS 2,751,953 A * 6/1956 Grimm ..... B65D 37/00 428/34.1
3,173,573 A * 3/1965 Donegan ..... B65D 1/32 220/666
4,744,476 A * 5/1988 McKee ..... A61J 9/00 215/11.1
5,447,110 A * 9/1995 Brown ..... B65D 1/0292 220/666

(Continued)

FOREIGN PATENT DOCUMENTS

CN 106794920 A 5/2017
WO WO-2020058673 A1 * 3/2020 ..... A45F 3/20

*Primary Examiner* — Orlando E Aviles
*Assistant Examiner* — Niki M Eloshway

(57) ABSTRACT

The invention relates to deformable sleeve with resilient core structure, including: the top and bottom of the sleeve; a resilient core device with one or more solid parts, which has a surface structure of a gap, and/or cavities and limits the distance between the first and second ends of the sleeve due to induced movement. Width of the sleeve is partially limited when it is in undeformed position, and its narrowest width size is partially limited when the sleeve is in deformed position; the outer wall of the resilient core device is partially connected, or secured to the sleeve at one or more ends of the deformable sleeve. The deformable sleeve and resilient core device can be used in combination with various products to improve grip, function or surface appearance. Deformation of the sleeve is limited to a specific structure through the resilient core to provide users improved experience.

8 Claims, 9 Drawing Sheets

(56) References Cited

U.S. PATENT DOCUMENTS

| | | | | |
|---|---|---|---|---|
| 5,913,448 | A * | 6/1999 | Mann | B65D 21/086 220/666 |
| 6,484,897 | B1 * | 11/2002 | Crawley | B65D 81/24 220/8 |
| 8,763,829 | B2 * | 7/2014 | Madaus | B65D 1/0292 220/666 |
| 2006/0081555 | A1 * | 4/2006 | Mori | B65D 1/0292 220/666 |
| 2011/0272419 | A1 * | 11/2011 | Vanderberg | B65D 21/086 220/666 |
| 2011/0284547 | A1 * | 11/2011 | McElligott | B65D 21/086 220/666 |
| 2013/0264340 | A1 * | 10/2013 | Zens | B65D 21/086 53/457 |

* cited by examiner

DEFORMABLE SLEEVE WITH RESILIENT CORE STRUCTURE

TECHNICAL FIELD

The invention relates to the field of deformable container technology. Specifically, it is a deformable sleeve with a resilient core structure that can be incorporated onto the surface of a container or object of cylindrical shape.

BACKGROUND

As we all know, when we use thermos cups, containers, cups, utensils, tools and other daily necessities, because the surface of these utensils is often very smooth, and there are no creases, spines, ripples, creases, or other surface texture. Therefore, when using it, there may be slipping due to carelessness, causing unnecessary error or damage to the item, thus affecting the function, performance and repeatability of the item. Therefore, it is necessary to incorporate a deformable surface onto these items, so as to provide improved, enhanced or changed functions, and can be effectively applied to a variety of applications.

At present, no effective solutions have been proposed for the problems in related technologies.

SUMMARY

The purpose of the invention is to provide a deformable sleeve with an resilient core structure to overcome the above problems in existing technologies.

In order to achieve the above purposes, the invention provides the following technical solutions: a deformable sleeve with an resilient core structure, including:

Deformable sleeve, with the top of the sleeve and the bottom of the sleeve;

The resilient core device of one or more solid parts is set in the inner boundary of the deformable sleeve. The resilient core device has a surface structure of gaps, notches, gap or cavities, and the surface structure limits the distance between the top and the bottom end of the deformable sleeve caused by the actuation. The above surface structure is contained within the deformable sleeve when the deformable sleeve is in its undeformed position, the width of the deformable sleeve is partially limited, and when the deformable sleeve is in the deformed position, the narrowest width of the deformable sleeve is partially limited;

The outer wall of the resilient core device is partially connected to the deformable sleeve at one or more ends of the deformable sleeve, and the resilient core device may, or may not form an air-tight combination with the deformable sleeve.

Further, the sleeve in the deformation position is in a predetermined shape. When the pressure is applied along the direction of the top of the sleeve, the predetermined shape is adjusted by the resilient core structure, and the pressure required for deformation is derived from the force exerted by the hand or other physical action.

Further, the bottom of the resilient core device is provided with a sealed tube, which is a hollow tube with a closed end. The sealed tube is equipped with a valve, through which air pressure can be added or removed.

Further, the resilient core device includes latch, latch release button, spring and lever.

Further, the latch can fix the deformable sleeve in its deformation position, and can release the deformation. After releasing the deformation, the sleeve returns to its undeformed position.

Further, the resilient core device has a closure or a hollow tubular shape at either end.

Further, the resilient core device does not have a closure or a hollow tubular shape at either end.

Further, the resilient core device has a tubular structure.

Further, the deformable sleeve and the resilient core device are combined to form a sheath.

Further, the resilient core device can be directly combined or molded to the surface of the product.

Furthermore, the deformable sleeve consists of at least one layer of elastic or non-elastic material.

Further, the elastic or non-elastic materials are plastics, rubber, cloth, metals and/or their composites.

Compared with the existing technology, the invention has the following beneficial effects:

1) The invention can be combined into various products to improve the grip, function or surface appearance. The deformation of the sleeve is adjusted to a specific structure through the resilient core to provide a improved experience for the user; 2) The invention has a simple structure and novel design.

In the picture, 1. Deformable sleeve, 2, resilient core device, 3. Surface structure, 4. Predetermined shape, 5. resilient core, 7. Latch lock, 8. Latch release button, 9. Sleeve structure, 10. Tubular objects, 11. Sealing tube, 12. Button, 13. The position is not pressed, 14. Removable cover, 15. Hinge cover, 16. Hinge, 17. Aluminum cans.

DETAILED DESCRIPTION

Next, a further description of the invention is made in combination with the specific implementation method and the attached drawings:

Example 1: (Implementation 1)

Figure 1:
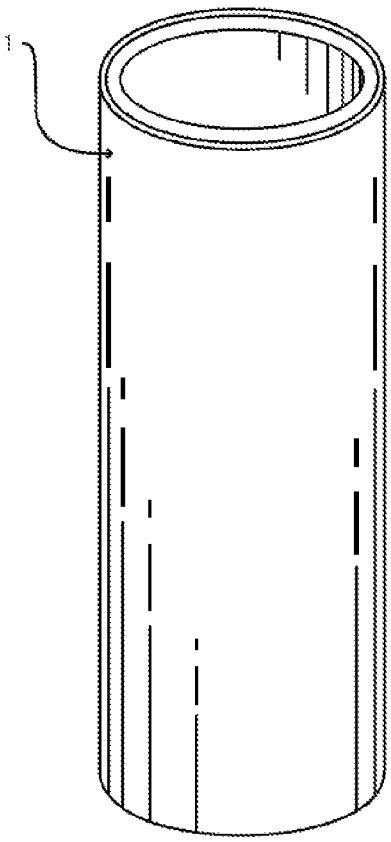
FIG. 1 is a three-dimensional diagram of the first embodiment in the undeformed position.
Figure 1A:
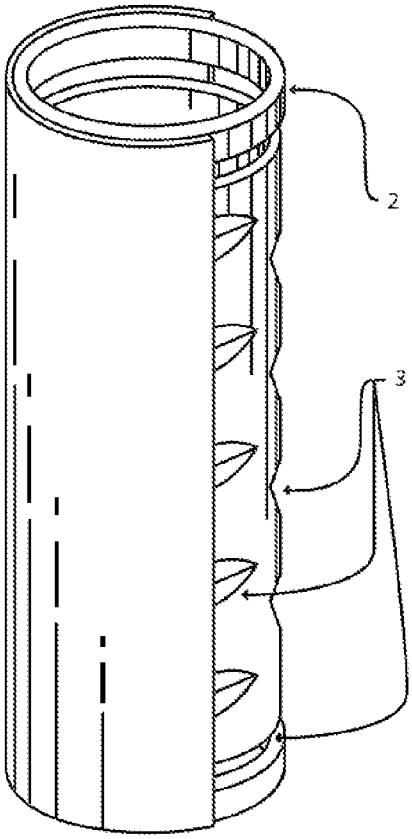
FIG. 1A is a three-dimensional diagram of the first embodiment of a device in an undeformed position, in which the profile of the sleeve shows the following resilient core structure.

As shown in FIG. 1 and FIG. 1A, a deformable sleeve with an resilient core structure, including: deformable sleeve 1, with the top of the sleeve and the bottom of the sleeve;

The resilient core device with one or more solid parts is set in the inner boundary of the deformable sleeve 1. The resilient core device 2 has a gap, concave, gap and or cavity surface structure 3, and the surface structure 3 limits and limits the distance between the top and the bottom of the deformable sleeve 1 caused by the movement. The surface structure 3 partially limits the width of the deformable sleeve when the deformable sleeve 1 is in its undeformed position, and partially limits the narrowest width size of the deformable sleeve when the deformable sleeve is in the deformed position;

The outer wall of the resilient core device 2 is partially connected to the deformable sleeve 1 at one or more ends of the deformable sleeve, and the resilient core device 2 forms an air-tight combination with the deformable sleeve.

Figure 2:
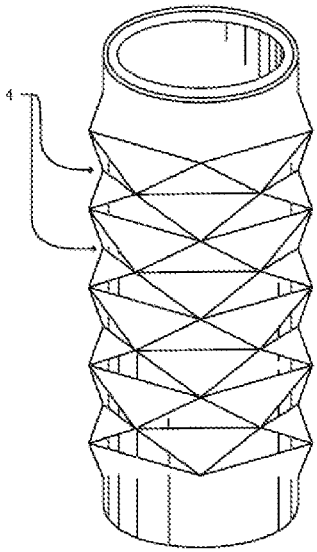
FIG. 2 is a three-dimensional diagram of the first embodiment in its deformation position.
Figure 2A:
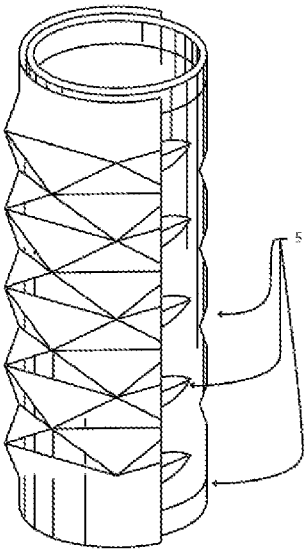
FIG. 2A is a three-dimensional diagram of the first embodiment of the device in its second deformation position, in which the profile of the sleeve shows the following resilient core structure.
Figure 2B:
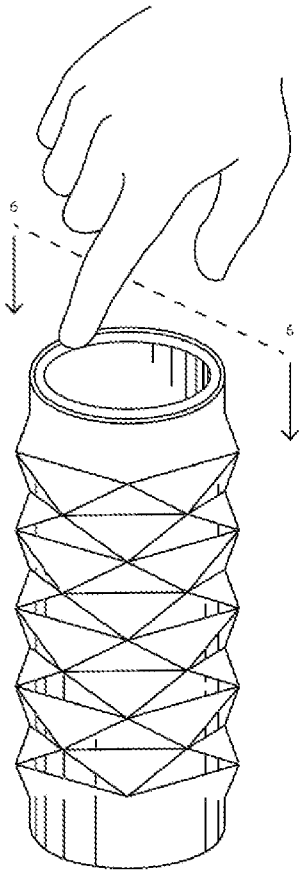
FIG. 2B is a three-dimensional diagram of the device that moves its second deformation position from its first position by applying a downward force to the top of the device.

As shown in FIG. 2, FIG. 2A and FIG. 2B, the deformed sleeve is in a predetermined shape 4. When the pressure is applied along the 6-6 direction, the predetermined shape 4 is adjusted by the structure of the resilient core structure 5. The pressure required for deformation can be obtained by the force exerted by the hand or other physical movement.

Figure 3:
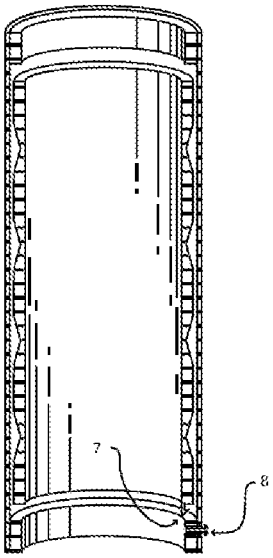
FIG. 3 is a cross-section of an embodiment in an undeformed position, including the latch mechanism.
Figure 3A:
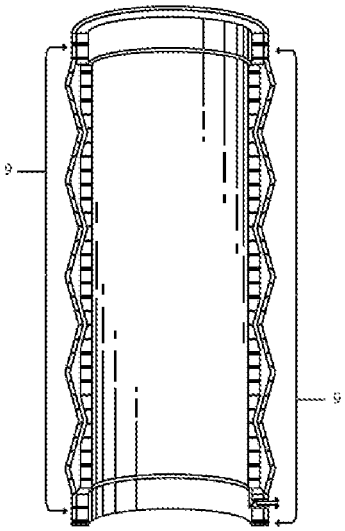
FIG. 3A is a cross-section of an embodiment in its deformed position, including the latch mechanism, which is kept in the appropriate position by the latch.
Figure 3B:
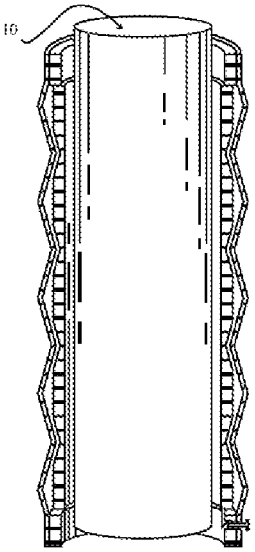
FIG. 3B is a cross-section of an embodiment, showing the tubular object placed in its core.

As shown in FIG. 3, FIG. 3A and FIG. 3B, the sleeve includes latch 7 and latch release button 8. The latch 7 can fix the sleeve in its deformed position and release the deformation, so that the sleeve can return to its undeformed position. The parts of the resilient core 5 structure can be connected to the area of the sleeve at one or two ends of The deformable sleeve 1 is a hollow tubular sheath structure, in which the tubular object 10 is installed in the inner area of the resilient core 5 structure.

Figure 5:
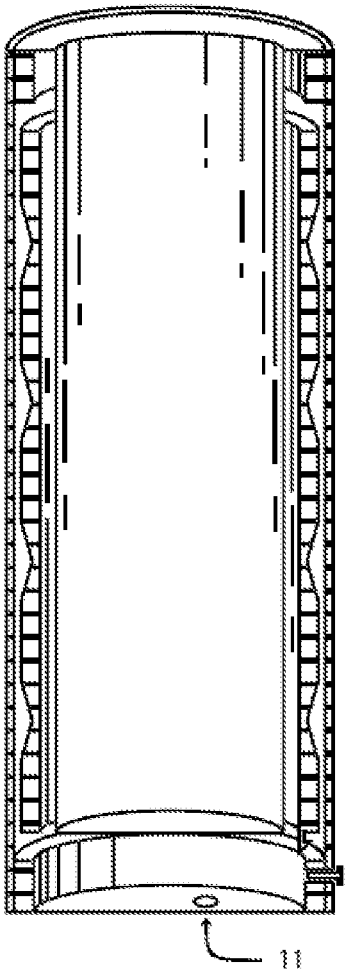
FIG. 5 is a cross-section of an embodiment of a device in an undeformed position, showing the resilient core device and sleeve that forms an airtight seal. The resilient core device and sleeve have a cylindrical interior area.
Figure 5A:
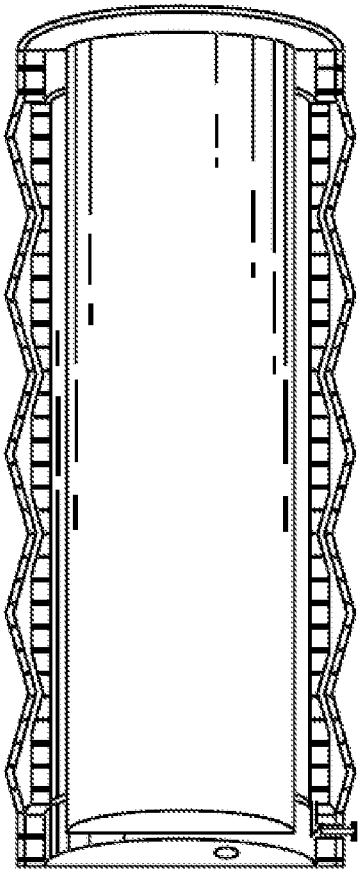
FIG. 5A is a cross section of an embodiment of an equipment in its deformed position, showing the core and sleeve that form an airtight seal. The resilient core device and sleeve have a cylindrical inner area.

As shown in FIGS. 5 and 5B, the bottom of the resilient core device is provided with a sealing tube 11. The sealing tube is a hollow tube with a closed end. The sealing part of the sealing tube is equipped with a valve, through which air pressure can be added or removed to affect the deformation of the deformable sleeve 1.

The deformable sleeve and the resilient core device are combined to form a sheath.

The resilient core device 2 can be directly combined or molded to the surface of the product. Various tubular products can be included in the sheath. Similarly, the core structure can be directly combined or molded to the surface of various products.

The deformable sleeve 1 is composed of at least one layer of elastic or non-elastic material.

The elastic or non-elastic materials are plastics, rubber, cloth, metals and/or their composite materials.

Example 2: (Example of)

Figure 4:
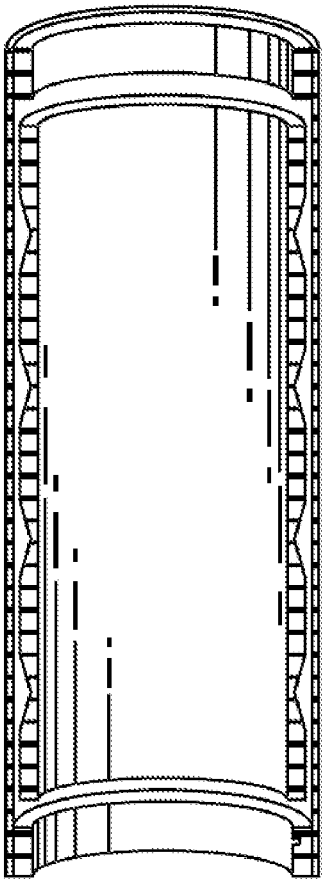
FIG. 4 is an alternative cross-section of an embodiment of a device in an undeformed position, which does not include the latch mechanism.
Figure 4A:
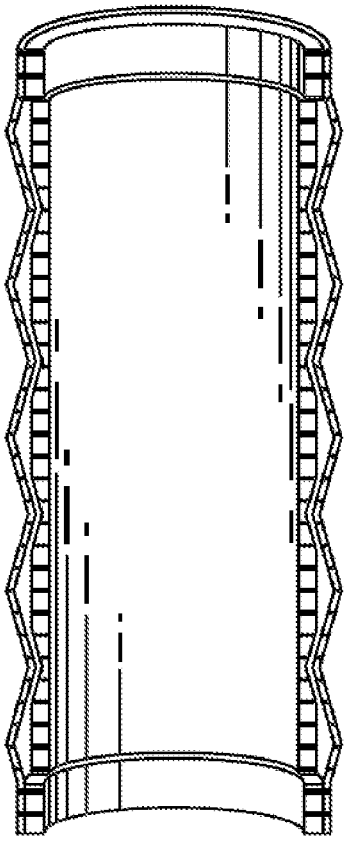
FIG. 4B is a cross section of an embodiment of a device in a deformed position, which does not include a latch mechanism.

FIGS. 4 and 4A describe the alternative embodiment of the deformable sleeve, excluding the latch mechanism used to adjust the deformation of the equipment. The sleeve is composed of reflexive materials such as plastics, so the embodiment will change from the deformed position to the undeformed position when the application of force is released. In addition, the sleeve is composed of malleable materials such as aluminum, so the embodiment will remain in the deformed position when the application of force is released.

Example 3: (Example)

Figure 6:
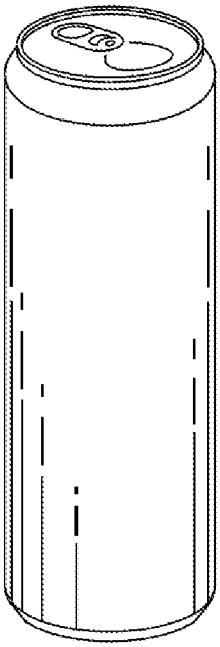
FIG. 6 is a three-dimensional diagram of an aluminum can in an undeformed position according to another embodiment of the invention.
Figure 6A:
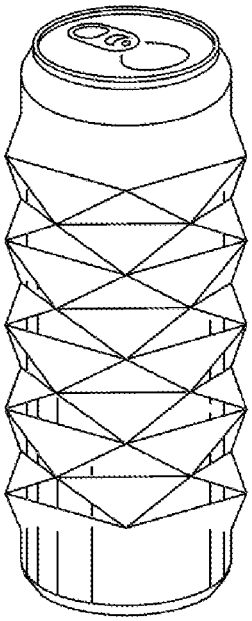
FIG. 6A is a three-dimensional diagram of an aluminum can in the deformed position according to another embodiment of the invention.
Figure 6B:
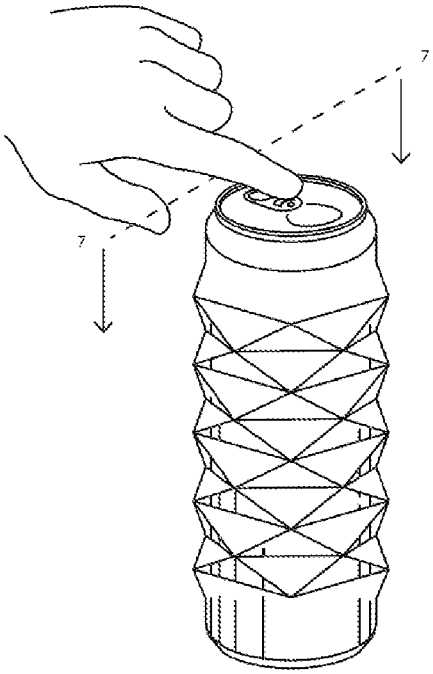
FIG. 6B is a three-dimensional diagram of the aluminum can in the device from the first position to the second deformation position by applying downward force to one or more ends of the device.

FIGS. 6, 6A and 6B show an embodiment of the invention, in which the aluminum can is contained within the structure of the deformable sleeve 1, as shown in FIG. 4. FIG. 6A shows that the deformable sleeve 1 shown in FIG. 6 is in the deformed position, thus providing enhanced gripping performance and stylized surface appearance. In addition, FIG. 6B shows that the deformable sleeve 1 shown in FIG. 6A is driven by manual force in the direction of 7-7. As shown in FIGS. 3 and 4, the device may or may not include the latch and latch release button. The latch and latch release button can fix the sleeve in its deformed position and release the deformation, so that the sleeve can return to its undeformed position.

Example 4: (Example)

Figure 7:
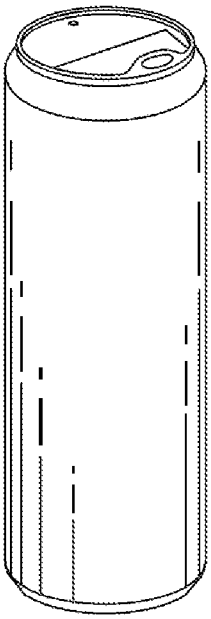
FIG. 7 is a three-dimensional diagram of a beverage cup in an undeformed position according to another embodiment of the invention.
Figure 7A:
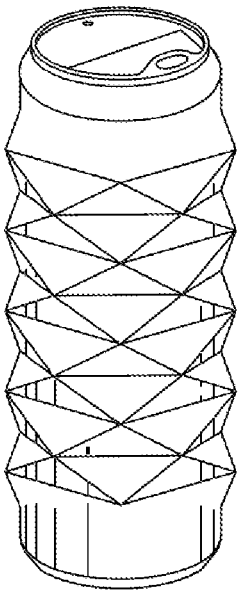
FIG. 7A is a three-dimensional diagram of a beverage cup in a deformed position according to another embodiment of the invention.
Figure 7B:
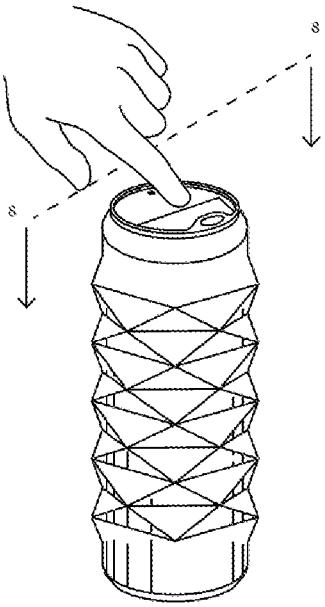

FIGS. 7, 7A and 7B show an embodiment of the invention, in which, as shown in FIG. 4, the beverage cup is contained in the structure of the deformable sleeve 1 or combined into the structure of the deformable sleeve 1. FIG. 7A shows that the deformable sleeve 1 shown in FIG. 7 is in the deformed position, thus providing the enhanced grip performance of the gripping surface and the stylized surface appearance. In addition, FIG. 7B shows the deformable sleeve shown in FIG. 7A by manually applying force in the 8-8 direction. As shown in FIGS. 3 and 4, the device may or may not include the latch and latch release button. The latch and latch release button can fix the sleeve in its deformed position and release the deformation, so that the sleeve can return to its undeformed position.

Example 5

Figure 8:
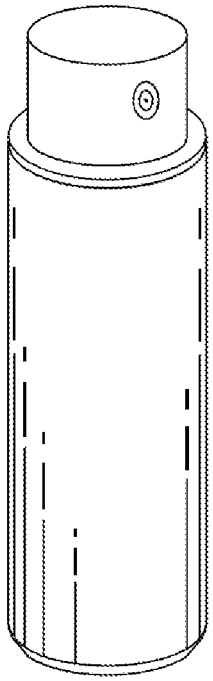
FIG. 8 is a three-dimensional diagram of a spray bottle in a device in an undeformed position based on another embodiment of the invention.
Figure 8A:
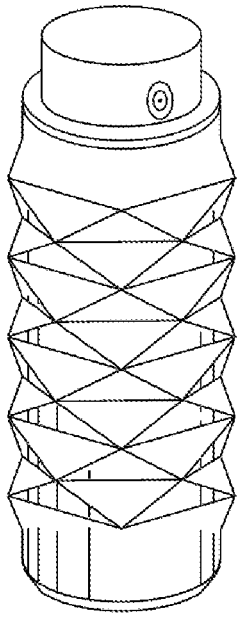
FIG. 8A is a three-dimensional diagram of a spray bottle in the deformed position according to another embodiment of the invention.
Figure 8B:
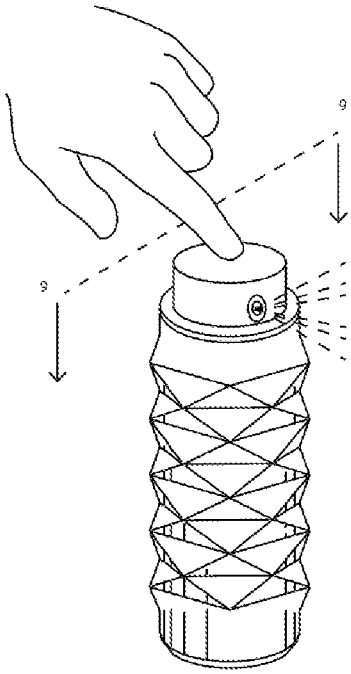
FIG. 8B is a three-dimensional diagram of the device shown in FIG. 8A by manually applying force in the direction of 9-9.

FIGS. 8, 8A and 8B show an embodiment of the invention, in which, as shown in FIG. 4, the spray bottle is accommodated within the structure of deformable sleeve 1 or combined into the structure of the device. FIG. 8A shows that the deformable sleeve 1 shown in FIG. 8 is in the deformed position, thus providing enhanced gripping performance and stylized surface appearance. FIG. 8B also shows the deformable sleeve 1 shown in FIG. 8A by manually applying force in the 9-9 direction. The embodiment uses the downward pressure of the pump button as the driving force to deform the deformable sleeve 1. As shown in FIGS. 3 and 4, the device may or may not include the latch and latch release button. The latch and latch release button can fix the sleeve in its deformed position and release the deformation, so that the sleeve can return to its undeformed position.

Example 6: (Implementation)

Figure 9:
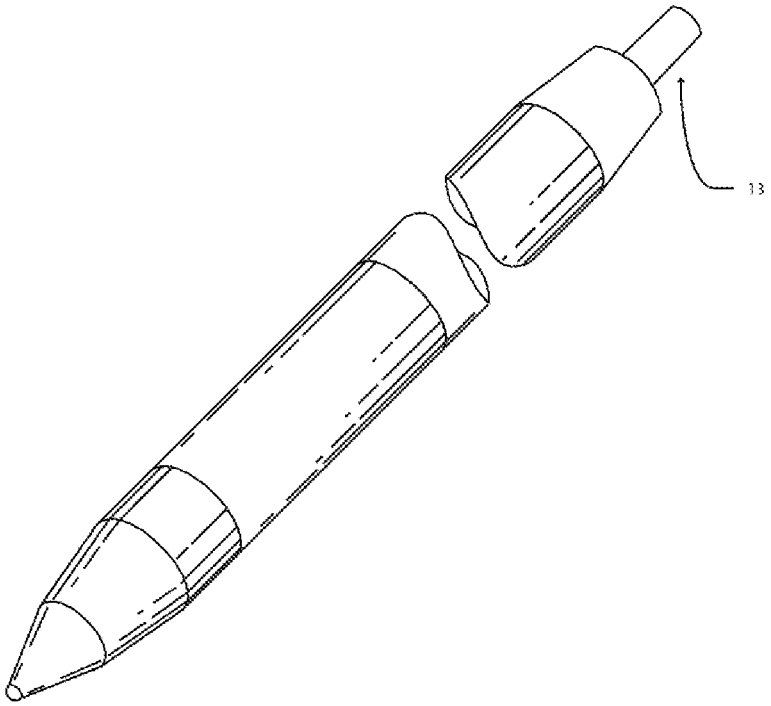
FIG. 9 is a three-dimensional diagram of a writing appliance in an undeformed position according to another embodiment of the invention.
Figure 9A:
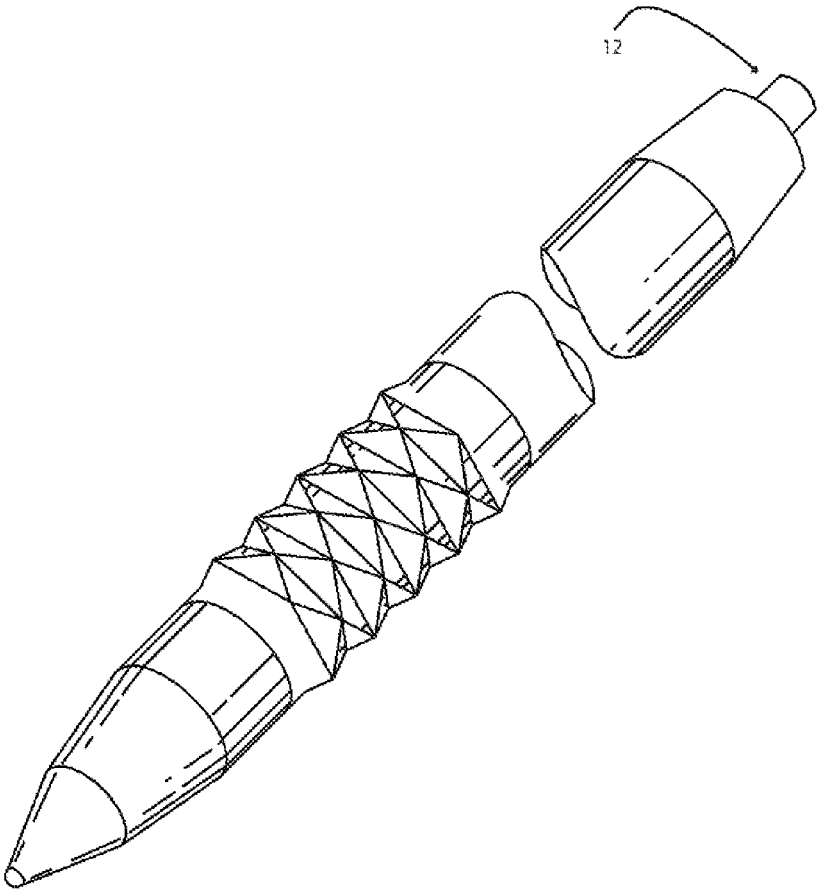
FIG. 9A is a three-dimensional diagram of a writing appliance in a deformed position according to another embodiment of the invention.

FIG. 9. FIG. 9A shows an embodiment of the invention, in which the deformable sleeve 1 is combined into the main body of the click pen. The embodiment uses the downward pressure of the pen click button 12 as the driving force to deform the deformable sleeve 1. FIG. 9A shows that the deformable sleeve shown in FIG. 9 is in the deformed position, thus providing enhanced gripping performance and stylized surface appearance. Click the pen button to its unpressed position 13 will return the sleeve to its undeformed position.

Example 7

Figure 10:
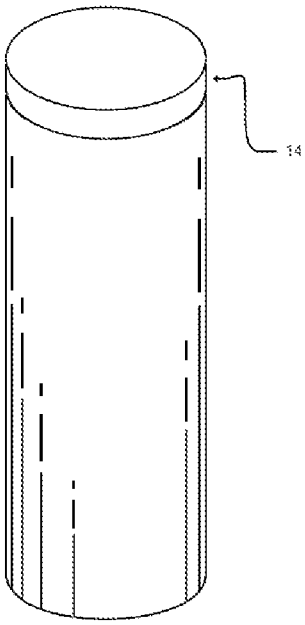
FIG. 10 is a three-dimensional diagram of a container with a removable cover in an undeformed position according to another embodiment of the invention.
Figure 10A:
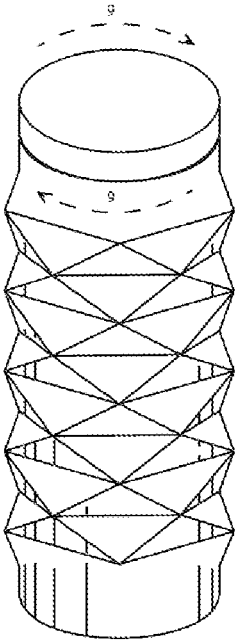
FIG. 10A is a three-dimensional diagram of a container with a removable lid in the deformed position according to another embodiment of the invention.
Figure 10B:
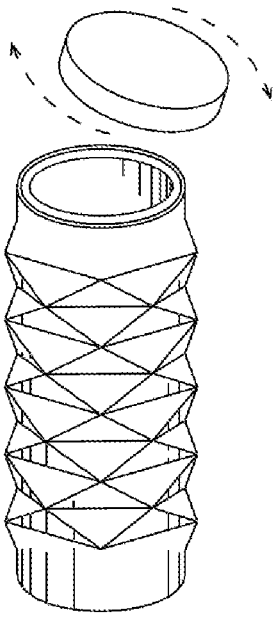

FIGS. 10, 10A and 10B show an embodiment of the invention as shown in FIGS. 3, 4 and 5. The embodiment includes a removable cover 14, which directly or indirectly contacts the resilient core structure of the deformable sleeve. FIG. 10A shows the torsion direction of 9-9, which removes the cover and causes deformable sleeve deformation by compression of the core structure through contact pressure, connecting rod mechanism or other mechanical means. FIG. 10B shows that the deformable sleeve is in a deformed position, in which the cover has been removed. By reversing the steps taken in FIG. 10A, replace the cover with a deformable sleeve to return the deformable sleeve to its undeformed position.

Example 8

Figure 11:
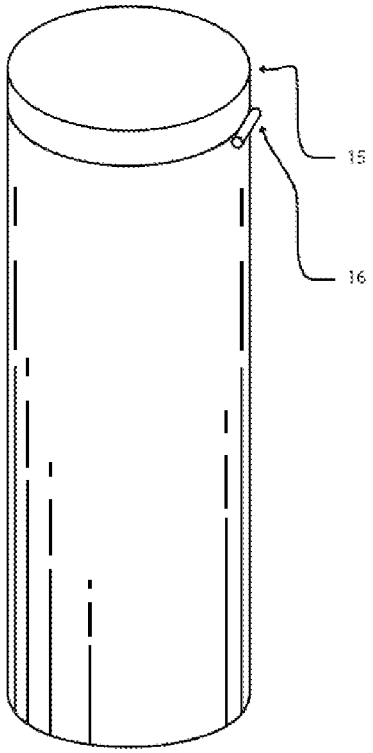
FIG. 11 is a three-dimensional diagram of a container with a hinged cover in an undeformed position according to another embodiment of the invention.
Figure 11A:
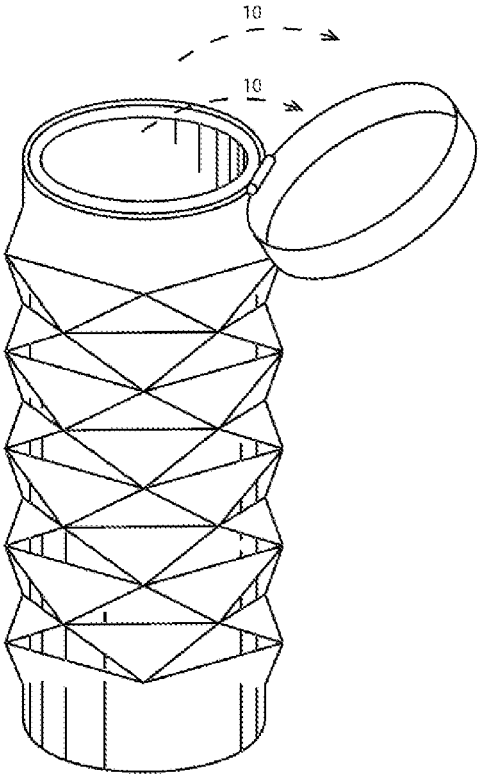
FIG. 11A is a three-dimensional diagram of a container with a hinged cover in the deformed position according to another embodiment of the invention.

FIGS. 11 and 11A are an embodiment of the invention, which shows a container with a hinged cover in an undeformed position, and the hinge cover 15 realizes the flipping of the cover plate by twisting the hinge. FIG. 11A is a container with a hinged cover in the deformed position according to an embodiment of the invention.

Example 9: (Example 9)

Figure 12:
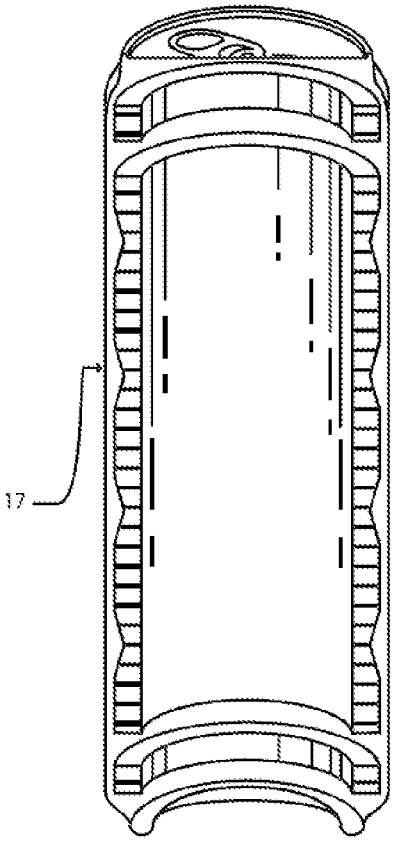
FIG. 12 is a three-dimensional diagram of an aluminum can containing an resilient core structure in its internal area. In this embodiment, the wall of the aluminum can be used as a deformable sleeve.
Figure 12A:
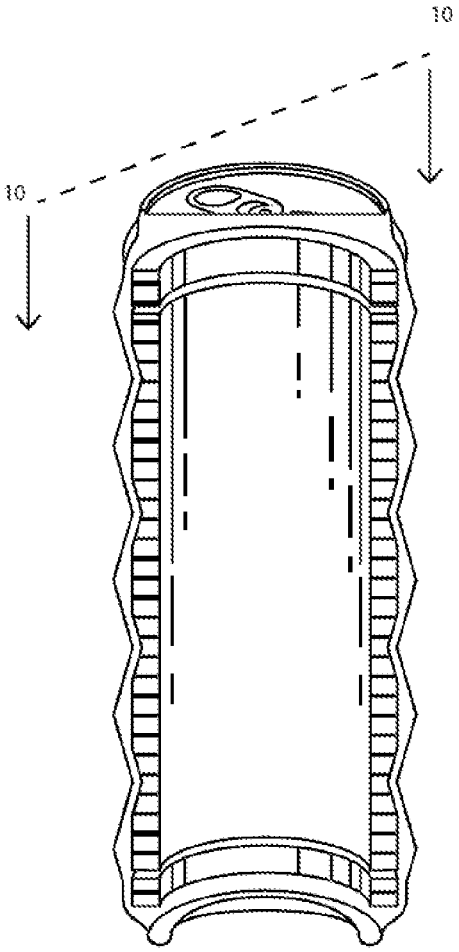
FIG. 12A is a three-dimensional diagram of an aluminum can containing an resilient core structure in the deformed position in its internal area according to another embodiment of the invention.

FIGS. 12 and 12A are three-dimensional drawings of an aluminum can 17 containing an resilient core structure in its internal area according to an embodiment of the invention. In this embodiment, the wall of the aluminum can 17 can be used as a deformable sleeve. FIG. 12A shows that the aluminum can 17 containing the resilient core structure in the internal area is in the deformed position according to an embodiment of the invention.

Finally, it should be noted that the above is only the preferred embodiment of the invention and is not used to limit the invention. Although the invention is explained in detail with reference to the above implementation examples, for technicians in this field, they can still modify the technical scheme recorded in the above embodiments, or modify its Some of the technical features are equivalently replaced. Any modification, equivalent replacement, improvement, etc. within the spirit and principles of the invention shall be included in the scope of protection of the invention.

What is claimed is:

1. A deformable sleeve with a resilient core structure, which is characterized by:

a side of the sleeve, a top of the sleeve and a bottom of the sleeve;

the resilient core device with a tubular structure of one or more solid parts is set within the inner boundary of the deformable sleeve;

a surface structure of gaps, notches, voids or cavities within an inner boundary of the deformable sleeve in between the tubular structure of one or more solid parts of the resilient core device, and the surface structure limits the reduction in distance between the top and bottom of the deformable sleeve caused by actuation, the surface structure partially limits a width of the deformable sleeve from an inside of the deformable sleeve to the side of the deformable sleeve when the deformable sleeve is in its undeformed position, and partially limits a narrowest width size of the deformable sleeve from the inside of the deformable sleeve to the side of the deformable sleeve when a deformable sleeve is in the deformed position;

the side of the sleeve has a predetermined shape that is adjusted by the gaps, notches, and voids or cavities of the surface structure when pressure is applied along the direction of the top of the sleeve, and the pressure required for deformation is derived from force exerted by a hand or other mechanism;

an outer wall of the resilient core device is partially connected, or secured to the deformable sleeve at one or more ends of the deformable sleeve; and the resilient core device forms an air-tight combination with the deformable sleeve; and wherein the resilient core device includes a latch, a latch release button, a spring and a lever.

2. The deformable sleeve with a resilient core structure according to claim 1, wherein a sealed tube at a bottom of the resilient core device, the sealed tube is a hollow tube with a closed end, and the closed end of the sealed tube is equipped with a valve, through which air pressure can be added or removed.

3. The deformable sleeve with a resilient core structure according to claim 1, wherein the latch fixing the deformable sleeve in its deformation position, and the deformation can be released, after the deformation is released, the sleeve returns to its undeformed position.

4. The deformable sleeve with a resilient core structure according to claim 1, wherein the resilient core device has a closed part or a hollow tubular shape at either end.

5. The deformable sleeve with a resilient core structure according to claim 1, wherein the resilient core device does not have a closed part or has a hollow tubular shape at either end.

6. The deformable sleeve with a resilient core structure according to claim 1, wherein the combination of the deformable sleeve and the resilient core device forms a sheath, and the resilient core device can be directly combined or molded to the surface of a product.

7. The deformable sleeve with a resilient core structure according to claim 1, wherein the deformable sleeve is composed of at least one layer of elastic or non-elastic material.

8. The deformable sleeve with a resilient core structure according to claim 7, wherein the material is plastic, rubber, cloth, metal and/or its composite materials.

* * * * *